US005794528A

United States Patent [19]

Gronig et al.

[11] Patent Number: 5,794,528

[45] Date of Patent: Aug. 18, 1998

[54] DEVICE FOR HOLDING TENSIONED SHEET-LIKE MATERIAL AND PROCESS FOR TENSIONING SAID MATERIAL

[75] Inventors: Hans-Ulrich Gronig, Schwarzenburg, Switzerland; Guido Kreuzer, Vlersen; Eckhard Napp, Grefrath, both of Germany

[73] Assignee: Anton Hurtz GmbH & Co. KG, Nettetal, Germany

[21] Appl. No.: 578,511

[22] PCT Filed: Jun. 24, 1994

[86] PCT No.: PCT/DE94/00722

§ 371 Date: Dec. 27, 1995

§ 102(e) Date: Dec. 27, 1995

[87] PCT Pub. No.: WO95/01261

PCT Pub. Date: Jan. 12, 1995

[30] Foreign Application Priority Data

Jun. 29, 1993 [CH] Switzerland ..... 1947/93

[51] Int. Cl.[6] ..... B05C 17/06

[52] U.S. Cl. ..... 101/127.1; 101/129; 38/102.91

[58] Field of Search ..... 101/127.1, 128, 101/128.1, 129; 38/102–102.91; 160/369, 371, 374.1, 378, 379

[56] References Cited

U.S. PATENT DOCUMENTS

| | | | |
|---|---|---|---|
| 3,553,862 | 1/1971 | Hamu | 101/127.1 |
| 3,908,293 | 9/1975 | Newman | 101/127.1 |
| 3,962,805 | 6/1976 | Hamu | 38/102.5 |
| 4,539,734 | 9/1985 | Messerschmitt | 38/102.91 |
| 5,097,761 | 3/1992 | Hamu | 101/127.1 |
| 5,271,171 | 12/1993 | Smith | 101/127.1 |
| 5,555,653 | 9/1996 | Morgan | 38/102.2 |

FOREIGN PATENT DOCUMENTS

| | | | |
|---|---|---|---|
| 2106447 | 4/1983 | United Kingdom | 101/127.1 |

*Primary Examiner*—Ren Yan

*Attorney, Agent, or Firm*—Herbert Dubno

[57] ABSTRACT

A sheet material, especially fabric, is tensioned in a stretching frame made up of frame sections which have grooves open at the surface at which the fabric or sheet material is applied and receiving two rigid symmetrical bars such that the sheet material is looped around one of these bars, passes between this bar and a wall of the groove and passes between the two bars, the groove being formed with opposite walls which converge toward the groove mouth which has overhang and is dimensioned to receive the bars. When the sheet material is tensioned, the one bar is pulled by the loop toward the mouth and the other bar rolls against the wall portion of the groove until both bars are wedged in the groove and the sheet material is clamped between the one bar and a wall portion of the groove and between the two bars.

15 Claims, 6 Drawing Sheets

DEVICE FOR HOLDING TENSIONED SHEET-LIKE MATERIAL AND PROCESS FOR TENSIONING SAID MATERIAL

CROSS REFERENCE TO RELATED APPLICATIONS

This application is a national phase application corresponding to PCT/DE94/00722 filed 24 Jun. 1994 and based in turn on Swiss national application 1947/93-7 filed 29 Jun. 1993.

FIELD OF THE INVENTION

The invention relates to a device for holding tensioned and sheet-like material, particularly fabric, in a stretching frame wherein, in each of the limbs of the frame a groove, running along the longitudinal direction of each frame section, is provided in the surface adjacent to the sheet-like material, whereby holding means can be inserted in the groove which maintain the sheet-like material in a stressed state.

Stretching frames are used especially in the screen printing field for supporting the fabric printing screen. The stretching of this fabric must be done to a preselected tension and must be very even.

A known solution for meeting these requirements consists in stretching the fabric by means of a known stretching device over a stretching frame, the fabric being then glued to the same in its stressed state and subsequently dried. After that the stretch frame with the stressed fabric is removed from the stretching device. This method has the disadvantage that when the stretching frame has to be reused, the glued-on fabric has to be removed, after which the stretching frame must be cleaned, this being done with corresponding solvents, which requires proper waste disposal. Further not all fabrics used for screen printing processes are suitable for gluing. This is the case especially for fabrics which have been treated prior to stretching, for instance fabrics which have been coated.

In the DE-A-32 39 319 a clamping device for screen printing frames is shown. The sections forming the frame are provided at their surface with a continuously running groove, into which a concavely shaped, band-like clamping body can be pressed, whereby the fabric is pressed into the groove together with the clamping body. With this system it is hard to achieve an even tensioning with the required stressing force, particularly also because a tensioning once the clamping body has been inserted, with the inserted clamping body is not possible. The clamping body serves rather for holding the fabric in place.

From U.S. Pat. No. 3,553,862 a stretch frame is known, which has adjustable sections. These adjustable sections are provided with a longitudinal groove, into which the fabric to be stretched is introduced and in which the fabric is clamped in place with one or two bars. These bars are made of an elastic material, whose deformation causes the pressure force exerted on the fabric. After the fabric has been clamped in place, the required stressing force can be produced by displacing the corresponding sections within the frame. With this frame it is possible to produce an even stretching of the fabric. The fastening to the frame can be done without adhesives. However due to the stressing possibility within the stretch frame this stretch frame becomes very difficult and expensive to produce.

OBJECT OF THE INVENTION

It is the object of the present invention to provide a stretch frame on which a fabric can be evenly stretched, on which the fabric is held with simple means and whose production is simple and inexpensive.

The device for holding a tensioned and sheet-like material, particularly fabrics, comprises sections forming a stretching frame, wherein in each running along the longitudinal direction of each of the sections is provided in the surface adjoining the sheet-like material, and in the groove holding means which maintain the sheet-like material in a stressed state can be inserted. According to the invention the holding means consist of rigid bars with a basically round cross section acting in pairs, which extend at least over a segment of the length of the groove, in its stretched state the sheet-like material runs around the first bar which in the groove rests against a projection, a region of the surface of the first bar and a region of the groove form a channel with a wedge-shaped cross section, the second bar being inserted wedged together with the first bar in the channel.

Alternatively a device for holding a tensioned and sheet-like material, particularly fabrics, comprises forming a stretch frame wherein in each groove running along the longitudinal direction of each of the sections is provided in the surface adjacent to the sheet-like material. In the groove holding means which maintain the sheet-like material in a stressed state can be inserted.

According to the invention the holding means can consist of rigid bars with a basically round cross section and acting in pairs, which extend at least over a segment of the length of the grove, in its stressed state the sheet-like material runs around the second bar, which rests against a surface area of the groove, the first bar is supported in the groove at a projection, and the surface area of the groove and an area of the surface of the first bar form a channel with a wedge-shaped cross section, in which the two bars are wedged together.

Expressed otherwise, a device for holding a tensioned sheet-like material particularly fabrics, comprises forming a stretching frame. In each of the sections a running along the longitudinal direction of each of the sections is provided in the surface adjacent to the sheet-like material. In the groove holding means which maintain the sheet-like material in a stressed state can be inserted. According to the invention the holding means consists of rigid bars with a basically round cross section and acting in pairs, which extend at least over a segment of the length of the groove, in the stressed state the sheet-like material runs around the first bar which is supported at a surface area of the groove, the second bar is supported in the groove at a projection, and the surface area of the first bar and the surface area of the groove form a channel with a wedge-shaped cross section in which the two bars are wedged together.

The invention lies also in a method for stressing this material on the stretch frame, which comprises the method of stressing sheet-like materials uses a device made of sections each of which has a continuous groove running in the longitudinal direction of each section in the surface adjacent to the sheet-like material, wherein the sheet-like material in its stressed state is held by bars cooperating in pairs, which lock against each other in the groove narrowed down on the side of the groove opening. In the method the sheet-like material is positioned on a section, the first bar is positioned over the sheet-like material on the groove and lowered into the latter, whereby the sheet-like material comes to lie in the groove under the first bar between the outside of the groove and the sheet-like material can be stretched by pulling outwardly with respect to the stressing area, whereby the second bar is lifted from a wedge-shaped channel formed between the outside of the groove and the first bar due to the rotation of first bar, and whereby the stressed material is held due to a wedging of the first bar and the second bar in the groove.

In the invention the sheet-like material can be positioned on the section, the second bar can be positioned over the sheet-like material on the groove and lowered into the latter, whereby the sheet-like material comes to lie in the groove, the first bar can be inserted between the inside of the grove and the sheet-like material, the sheet-like material can be also stressed outward by pulling the same from the stressing area towards the outside, whereby the first bar is lifted due to the rotation of the second bar which thereby locks itself together with the first bar in a wedge-shaped channel formed between the outside of the groove and the first bar.

Advantageously the groove is shaped so that a region of the surface of the first bar inserted in the groove and a region of the groove surface form together a wedge-shaped channel into which the second bar can be lodged. Thereby the fabric is wrapped around the first bar. During the tensioning of the fabric this first bar is pressed against the projection provided in the groove. In order to stretch the fabric this first bar is turned in a direction which causes the second bar to lift in the direction of the opening wedge. As a result the fabric to be stretched can be moved against the stretching direction through the groove around the first bar. As soon as the first bar is turned in the opposite direction of rotation, the second bar is pressed into the wedge, whereby the first bar is wedged in together with the second bar. In this way an optimal fastening of the stressed material is achieved.

Advantageously the groove opening directed against the surface of the section is limited by a projection and an adjoining shoulder. A width of the opening results which is larger than the larger diameter of one of the two bars, but which is smaller than the sum of the diameters of both bars. Thus in the wedged position of the two bars and consequently when the fabric is stretched an escape of one or both bars from the groove is made impossible. The stressed fabric is optimally secured against release.

Advantageously the region of the groove against which the first bar rests in the stressed position of the material to be stretched has a shape complementary to this bar. Thereby an optimal clamping effect is achieved for the material to be stressed.

The surface of the groove area which forms the outer side of the wedge-like channel seen in cross section is advantageously shaped like an arc of a circle having a radius which is only slightly larger than the sum of the radius of the first bar and the diameter of the second bar. In order to achieve the shape of a wedge the center of this arc of circle is in a slightly offset position towards the surface of the frame, with respect to the center of the first bar when it is resting against the projection.

A further advantageous embodiment of the invention consists in that both bars are provided at one or both ends with a section on which a turning handle can be fitted for turning the corresponding bar. When the fabric is stressed, it is possible for instance to achieve the wedging of the bars by rotating the second bar so that it enters deeper into the wedge-shaped channel, whereby the fabric is already wedged in when the stretching device is released and as a result of the wedging no receding of the fabric occurs.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
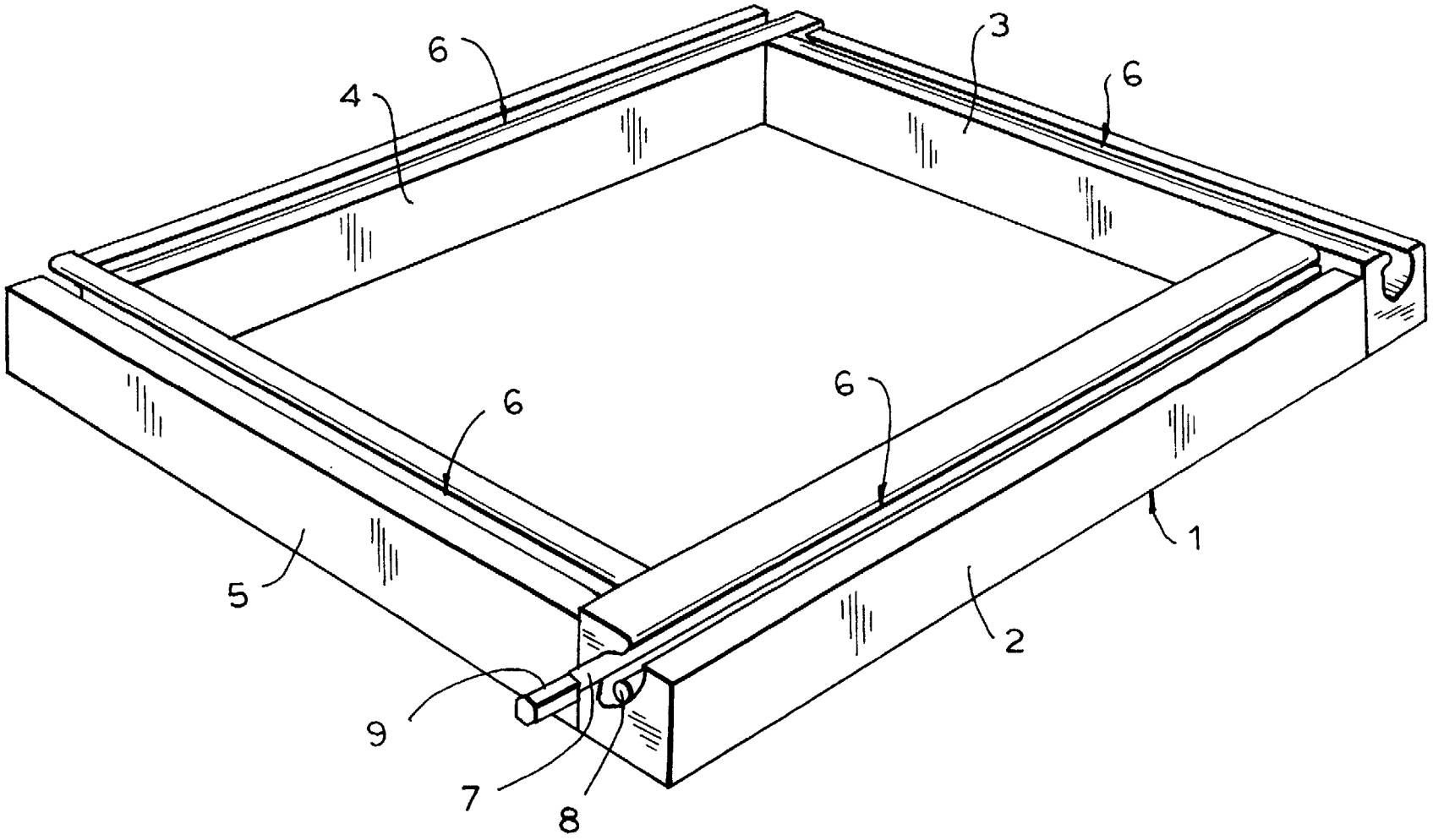
FIG. 1 is a perspective view of a stretching frame composed of frame sections.

The stretching frame shown in FIG. 1 is composed of four sections 2 to 5, which basically form a regular rectangle. The sections 2 to 5 are joined together in such a manner that an end of one section abuts an end portion of a longitudinal side of the adjoining section. In each of the sections 2 to 5, at the surface area in contact with the sheet-like material, a groove 6 is provided which runs in the longitudinal direction of each of sections 2 to 5. Due to the joining of the sections 2 to 5 shown in FIG. 1 in each corner of the stretch frame 1 a groove 6 ends 1, each groove 6 opens on the outer side of the stretch frame 1.

In each groove 6 a first bar 7 and a second bar 8 are lodged, whereby the groove has a corresponding shape which will further be described. The two bars 7, 8 can each be provided at their ends with a section 9, which in this example is designed as a hexagonal section. The two bars 7, 8 can project beyond the groove on one side and can protrude slightly beyond the margin of the stretch frame 1. This makes possible to fit a turning handle shown in the drawing the hexagonal section 9 of the corresponding bar 7, respectively 8, by means of which the corresponding bar 7, respectively 8 can be rotated, whereby the purpose of such rotation will be later described.

Figure 2:
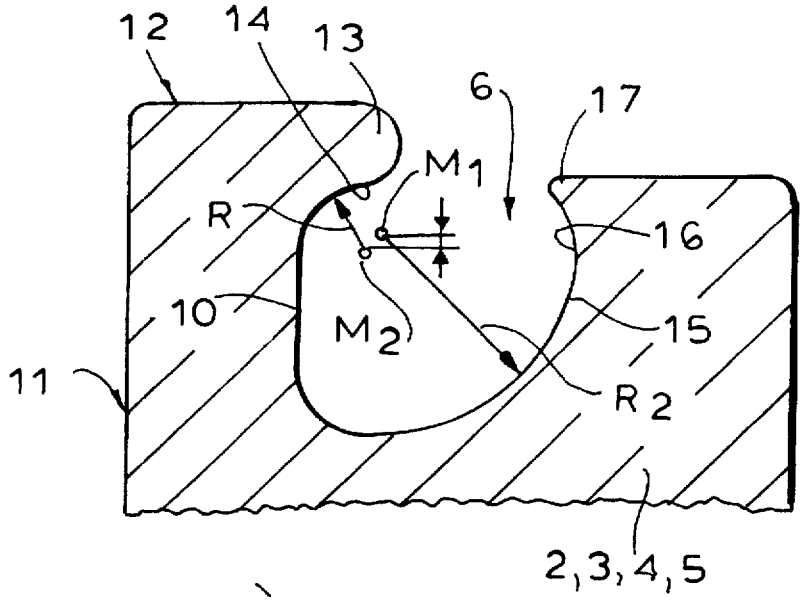
FIG. 2 is a sectional view of a section of the stretching frame in the region of the groove.

FIG. 2 shows the shape of the cross section of groove 6 in the sections 2 to 5. The inner side 10 of groove 6, which is directed towards the inner side 11 of the stretch frame 1 formed by sections 2 to 5, is provided with a projection or overhang 13 in the area adjoining the surface 12 against which rests the material to be stressed. From the lower side of the projection 13 starts a surface which defines the groove 6 and which in cross section has the shape of an arc of a circle 14 with a radius R. The center of the arc of circle 14 is marked $M_2$. Starting from the arc of circle 14 the inner surface of groove 6 runs perpendicularly to the surface 12 inward.

The outer side 15 of groove 6 is formed by a surface which in cross section also has the shape of an arc of a circle 16, whose radius is $R_2$ with its center marked $M_1$. The center $M_1$ is offset with respect to the center $M_2$ by the distance a towards the surface 12 of groove 6. The stretch a equals approximately one tenth of the diameter of the first bar 7. The arc of circle 16 is closed off towards the surface 12 by a shoulder 17 provided there.

Figure 3:
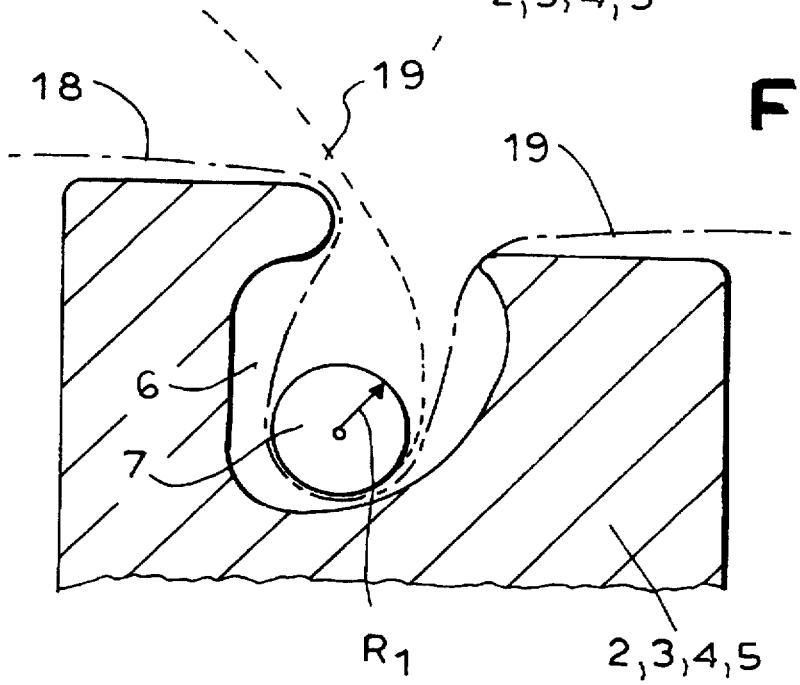
FIG. 3 is a sectional view according to FIG. 2, in which the first bar is fitted in the groove.

The sheet-like material 18 to be tensioned in the stretch frame 1 can be positioned on the stretch frame so that it covers the groove 6 of the corresponding sections 2 to 5. Then the first bar 7 is introduced into the groove 6, whereby the first bar 7 comes to lie on the sheet-like material 18 which has also been pressed into the groove, as can be seen from FIG. 3. The opening of groove 6, limited by the projection 13 and the shoulder 17 (see FIG. 2), has a width which is slightly larger than the diameter of the first bar 7. The radius $R_1$ of the first bar 7 basically corresponds to the radius R (FIG. 2). After the first bar 7 is lodged in the groove 6, the outside end 19 of the sheet-like material 18 is bent up as shown in broken lines in FIG. 3 at 19'.

Figure 4:
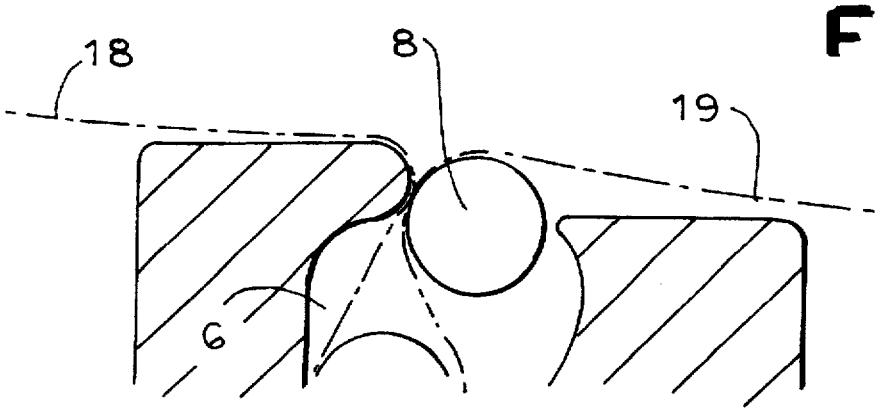
FIG. 4 is a sectional view according to FIG. 2, in which the second bar is fitted in the groove.

In the so-created opening of the groove 6 the second bar 8 is then introduced, as shown in FIG. 4. This second bar 8 has the same diameter as the first bar 7. The outside end 19 is then again bent outwardly from its bent-up position.

Figure 5:
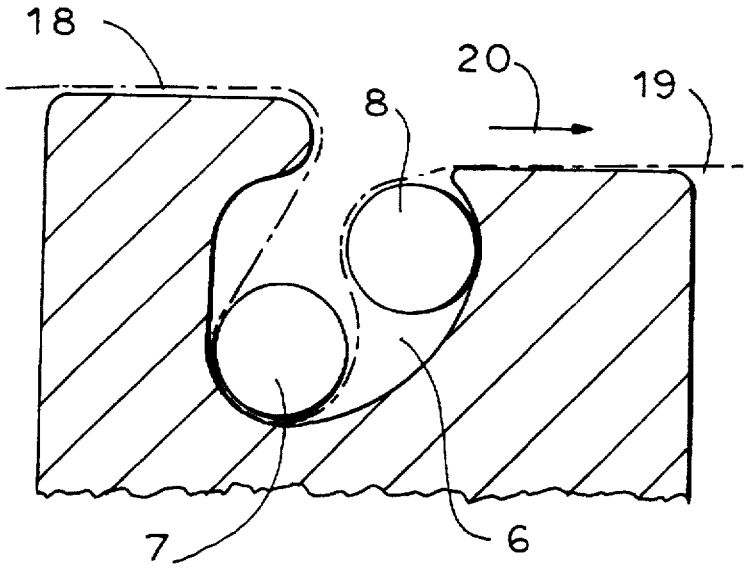
FIG. 5 is a sectional view according to FIG. 2, with the first and second bars lodged in the groove, prior to the stressing of the fabric.

The second bar 8 comes then in contact with the arc of circle 16 of groove 6, as can be seen from FIG. 5. The outside end 19 of the sheet-like material 18 can now be fastened in a known stretching mechanism, not shown in the drawing, and after that the sheet-like material 18 is stressed in the direction of arrow 20 (FIG. 5).

Figure 6:
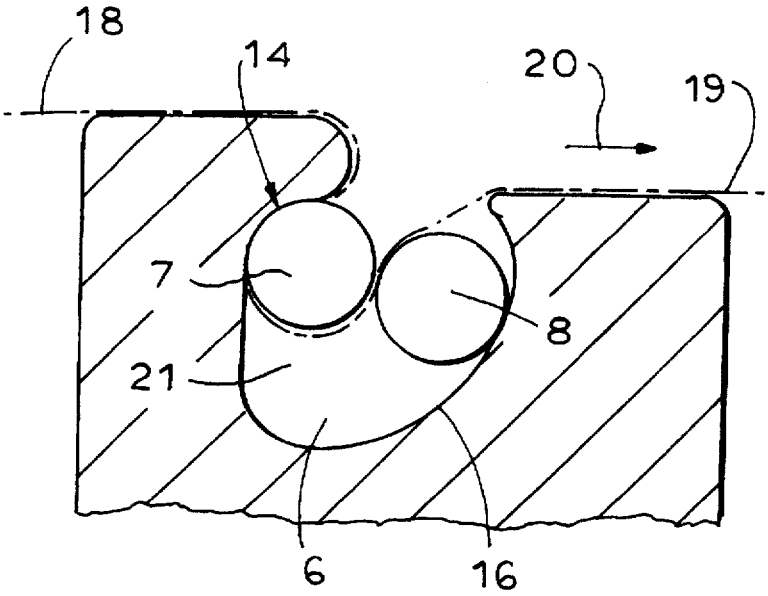
FIG. 6 is a sectional view according to FIG. 2 whereby both bars are in the groove in the wedged position.

During the tensioning of the sheet-like material 18 the first bar 7 is pulled upwardly from the groove bottom (FIG. 6), until the first bar 7 is juxtaposed with the arc of circle 14 of groove 6. Due to the presence of the second bar 8 a further displacement of the first bar 7 is avoided. The tensioning of the sheet-like material 18 in the direction of arrow 20, as shown in FIG. 6, causes a counterclockwise rotation of the first bar 7, whereby the second bar 8 is pressed in the direction of the wedge-shaped channel 21 formed by the surface of the first bar 7 and the arc of circle 16. As soon as the tension at the outside end 19 ceases, the first bar 7 has the tendency to rotate clockwise, whereby the second bar 8 is pressed downwards into the wedge-shaped channel 21, which causes the second bar 8 and consequently the first bar 7 to be wedged in. As a result the stressed sheet-like material 18 is locked in a stressed state.

The wedging of the second bar 8 in the wedge-shaped channel 21 can be enhanced by clockwise turning the second bar 8 in the position shown in FIG. 6 via the hexagonal section 9 (FIG. 1) with the rotation of handle.

The stressing of the sheet-like material 18 can also take place by turning the first bar 7 counterclockwise in the state shown in FIG. 6, via the hexagonal section 9 (FIG. 1). The friction of the sheet-like material 18 on the first bar 7 is sufficient to bring the sheet-like material 18 to the desired degree of tension. After this type of stressing is concluded, the first bar 7 and the second bar 8 are wedged in, as described above.

The two bars 7, 8 extend over the entire length of the groove 6 and consist of a rigid material, for example metal.

Figure 7:
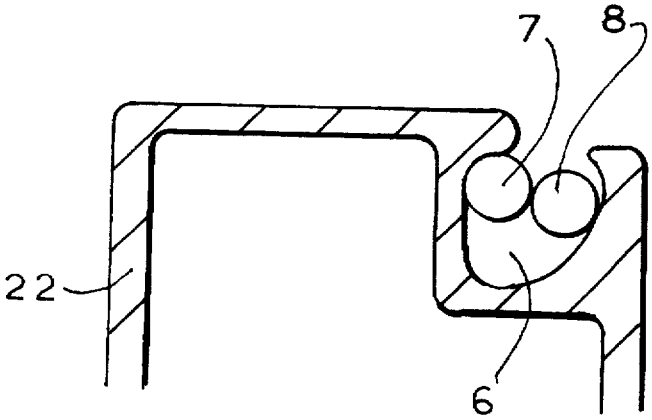
FIG. 7 is a sectional view of another embodiment of the a section.

From FIG. 7 it can be seen that the cross section shape of sections 2 to 5 can be a hollow section 22, whereby preferably in one corner the groove 6 is provided. Such a hollow section 22 can be made of extruded aluminum.

Figure 8:
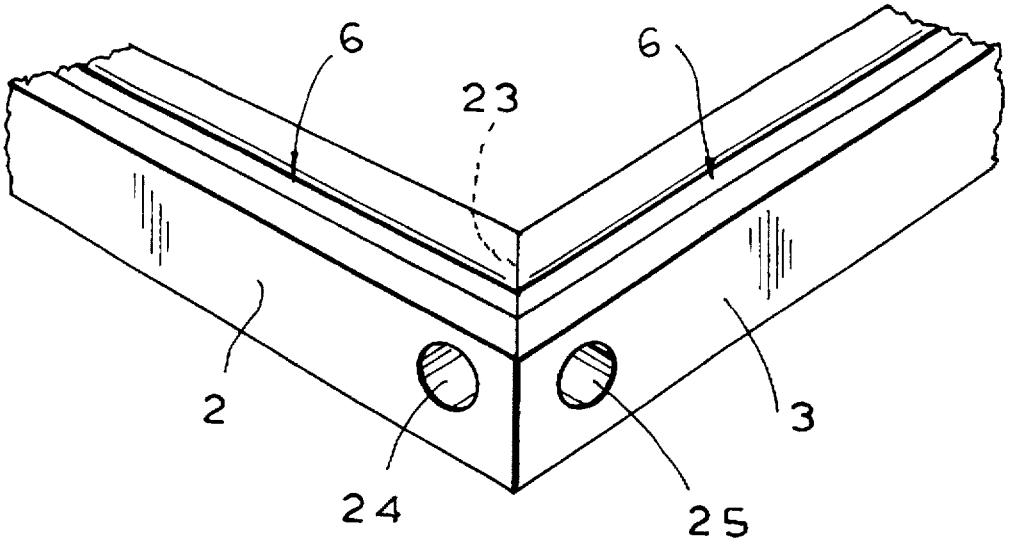
FIG. 8 is a further embodiment of a corner connection of the sections forming a stretching frames.

An embodiment of a corner connection of two adjoining sections, which differs from the variant described in FIG. 1, is shown in FIG. 8. The sections, for instance section 2 and 3 are each provided at the end with a miter surface 23. For the connection of the two sections 2, 3 they are arranged with the miter surface 23 on top of each other and joined in the known fashion. In order to be able now to turn the first bar 7, respectively the second bar 8 which are inserted in the corresponding grooves 6 by means of a turning handle, in the corner area of the connection of the two sections 2, 3 two openings 24, respectively 25 are provided, which coming from the outside end in the corresponding grooves 6. Consequently these openings 24, 25 lie each in the longitudinal axis of the corresponding groove 6.

Figure 9:
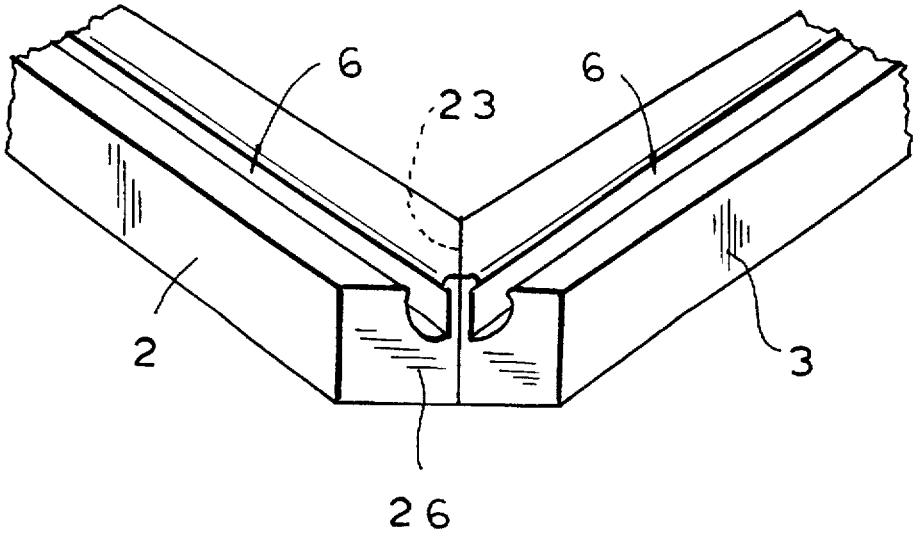
FIG. 9 is a further embodiment of a corner connection for the sections forming a stretching frame.

A further embodiment variant of a corner connection between two adjoining sections is shown in FIG. 9. The two sections, for instance sections 2, 3 are each provided in the same manner with a miter surface 23 and joined to each other as described in FIG. 9. In order to make possible the access of a turning handle to the first bar 7 and the second bar 8 inserted in the corresponding groove 6, the corner area cut along a cutting plane 26. This cutting plane 26 is perpendicular to the frame surface and to the corresponding miter surface 23 and runs on the inside of the two grooves 6 meeting at the respective corner. Consequently both grooves 6 end in the cutting plane 26. The access of a corresponding turning handle to the first bar 7 and the second bar 8 is insured.

When the first bar 7 and the second bar 8 do not project over the frame margin in the corner connections of the sections as described so far, then the corresponding groove end in the area of the hexagonal section can be provided with a recess in such a manner that it becomes possible to fit the turning handle onto the hexagonal section of the respective bar. Instead of this it is also possible in all embodiments of the bars 7, 8 to actuate them by means of a polygonal socket.

Figure 11:
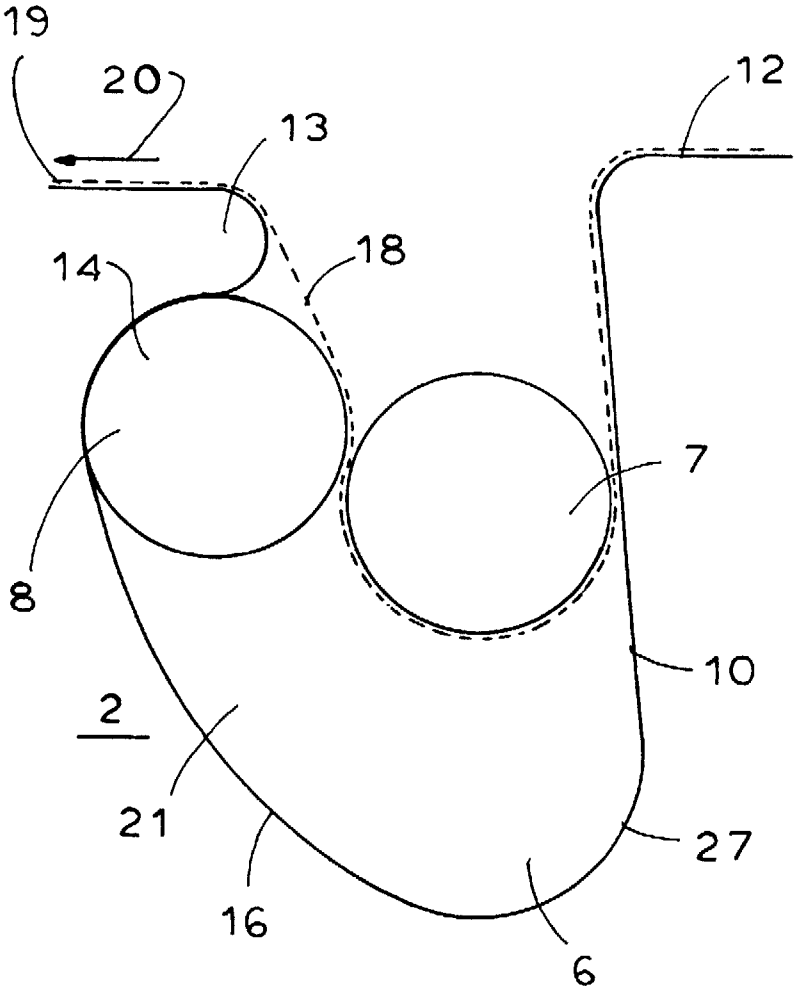
FIGS. 10,11 are illustrations corresponding to FIG. 6 of the groove region with a modified area with modified detail configuration and modified guidance of the sheet-like material.
Figure 10:
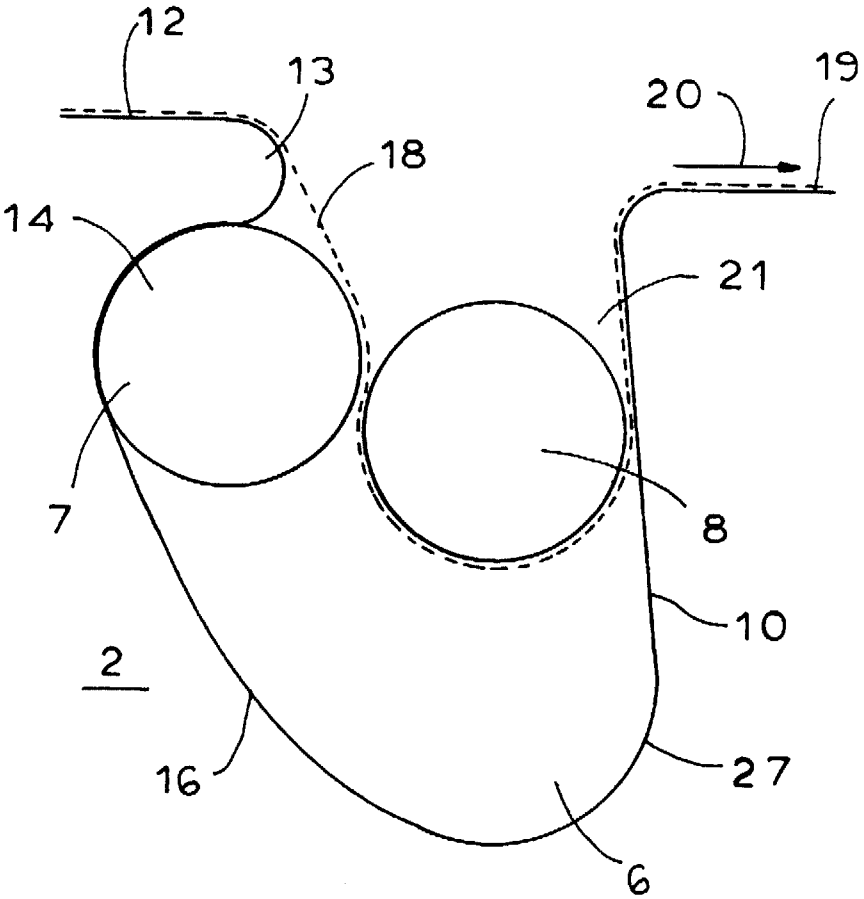

The groove region shown in FIG. 10, 11 is similar to the illustrations of FIG. 2 to 7. Particularly the groove 6 consists of a surface in the shape of an arc of circle 16, which is adjoined on the one side by an arc of circle 14 towards the projection 13 and on the other side via an arc of circle 27 of a smaller radius by a flat wall 10, which extends up to the level of projection 13., where it can have a shoulder 17 for limiting the opening of the groove 6. Whether the arc of circle 16 or the wall 10 forms the outer side the inner side of the groove 6 depends on which side of the illustration plane the sheet-like material 18 is fastened. This fastening can be done by means of any desired blocking element, for instance by a separate tie rod parallel to the projection 13, or the like, when the sheet-like material 18 is a truck tarpaulin or a tent canvas. In this case the section 2 should be braced or reinforced in any other way, so that during the tensioning of the sheet-like material 18 it can not move in the direction of the blocking element, thereby diminishing the stretch effect. When the section 2 is a component of a stretching frame for screen printing, the surface 12 is the respective surface of the stretch frame on the side of the printing screen, whereupon the material to be stressed comes to lie and has to be kept stretched. The arrow 20 correspondingly indicates the direction in which the sheet-like material 18 is stretched, in order to be kept in a tensioned state by the bars 7, 8 located in groove 6. Correspondingly in FIG. 10 the wall 10 is the outer side of groove 6 and the arc of circle 16 is the inner side of groove 6, while in the representation of FIG. 11 the arc of circle 16 is the outer side of groove 6 and the wall 10 is the inner side of groove 6.

As described in previous embodiments the bars 7, 8 are rigid bars and, according to necessity, they are provided also with the aforedescribed elements, such as for instance a hexagonal section for applying a turning handle. They have the same diameter and the same size in relation to the size of groove 6 as the bars 7, 8 of the previously described embodiments. The one of bars 7, 8 which adjoins the tensioned sheet-like material 18 held outside of section 2 was always the one described as first bar 7.

In FIG. 10 the first bar 7 is shown below the projection 13 in a clamped position together with bar 8. In contrast to the aforedescribed embodiments of FIGS. 2 to 7, the sheet-like material 18 is wrapped around bar 8. The tensioning and the wedging of bars 7, 8 takes place in that at first the sheet-like material 18 is spread over the groove 6 and is pressed into the groove 6 with the second bar 8, until the bar 8 and the thereto adjoining segment of the sheet-like material 18 are in the proximity of the groove bottom. After that the first bar 7 is arranged between the sheet-like material 18 and the surface 12 of projection 13 and inserted into the groove 6 or arranged within the groove 6, e.g. in the area of the arc of circle 14 below the projection 13. This arrangement of bar 7 takes place according to the possibilities. When the sheet-like material 18 can be flapped over as in FIG. 3, here towards the wall 10, the bar 7 can be introduced transversely. It is also possible to slide it in under the sheet-like material 18 in the longitudinal direction of bar 7. After the arrangement of bars 7, 8 in the groove 6, the free edge of the sheet-like material 18 is pulled in the direction of arrow 20, so that the bar 8 is lifted. Thereby the bar 7 is also lifted at the same time, since due to a corresponding selection of the size of the distance between the bar 8 and the arc of circle 16 it is insured that the bar 7 does not fall through between these two. When the bar 8 is lifted it is rotated counterclockwise. The bar 7 is correspondingly clockwise rotated. This motions continue until the bar 8 is locked in the wedge-like channel 21, which is formed between a surface area of the first bar 7 and the surface area of the groove 6, respectively the wall 10. Correspondingly the channel 21 runs perpendicularly to the illustration plane. From the point of view of its wedge angle the wedge-shaped channel 21 can be more pointed or more obtuse, since the wall 10 is more or less inclined with respect to the vertical. Correspondingly the opening of the groove 6 can be smaller or bigger. FIG. 10 shows a comparatively slight inclination of wall 10, which works in the sense of self-locking, in order to wedge in the bars 7, 8. The wedging, respectively the locking of bars 7, 8 in the sense of self-locking takes place under the effect of projection 13, as soon as the traction force at the outer end 19 of the sheet-like material 18 diminishes. Then this material 18 tries to rotate bar 8 clockwise and bar 7 counterclockwise, whereby the second bar 8 is upwardly wedged together with the first bar 7. The sheet-like material 18 is then secured in a tensioned state.

In FIG. 11 the sheet-like material 18 kept stressed outside the section 2 is placed on the right, so that the first bar 7 is arranged to the right of the bar 8, in contrast to FIG. 4. In the embodiment of FIG. 11 the insertion of bars 7, 8 takes place in a similar manner to the one shown in FIG. 3 to 5. At first the sheet-like material 18 is positioned over the groove 6 and the first bar 7 presses the sheet-like material 18 downward into the groove 6. After that the end 19 can be brought into a position similar to the one at 19' in FIG. 3, in order to insert the second bar 8. When after that the end 19 of the sheet-like material 18 is being pulled, the bar 7 is lifted by turning clockwise, whereby the bar 8 is also lifted, since the passage between bar 7 and the arc of circle 16 is too small for the bar 8 to fall down through it. When the bar 7 can no longer be pulled upwards, or rotated, the material 18 is released, so that the stress of the tensioned sheet-like material 18 causes a counterclockwise rotation of bar 7 and thereby the second bar 8 is rotated clockwise. But since the first bar 7 forms with one surface area of groove 6, respectively of the arc of circle 16, a wedge-shaped channel with a wedge-shaped section, both bars 7, 8 are wedged in together.

Depending on the selection of the material for the involved components of the device, respectively of the stretch frame and on the frictional characteristics of the sheet-like material 18 it can be necessary to influence the various designs of the involved components, in order to achieve the described action of the components for the improvement of the desired stressing of the material 18 or for its occurrence. For instance it could be necessary to design the bars 7, 8 with different diameters. For instance in the embodiment example of FIG. 6 the bar which is not wrapped could have a larger diameter in order to prevent a quick locking of the two bars 7, 8 when the end 19 of the material 18 is being pulled. The material 18 can then be stretched much better. In the same sense it could also be of advantage when the radius $R_1$ of the first bar 7 is larger or smaller than the radius R of the arc of circle 14, which starts from the lower side of projection 13. A corresponding reduction of the friction of the first bar 7 with the arc of circle 14 can prevent the bars 7, 8 from locking too early. In this sense the device can be developed so that the area of groove 6 against which the first bar 7 rests when the sheet-like arched material is stressed be provided with a coating which changes the friction coefficient of this area.

The device can be used advantageously in combination with stretch frames known per se for screen printing, by arranging it in the outer periphery of a rotatable and adjustable tensioning roller. Similar tensioning rollers are already known from the U.S. Pat. No. 3,908,293. The two rigid bars seize and hold the arched material 18, after which the tensioning roller is rotated and locked, thereby stretching the sheet-like material.

Figure 12:
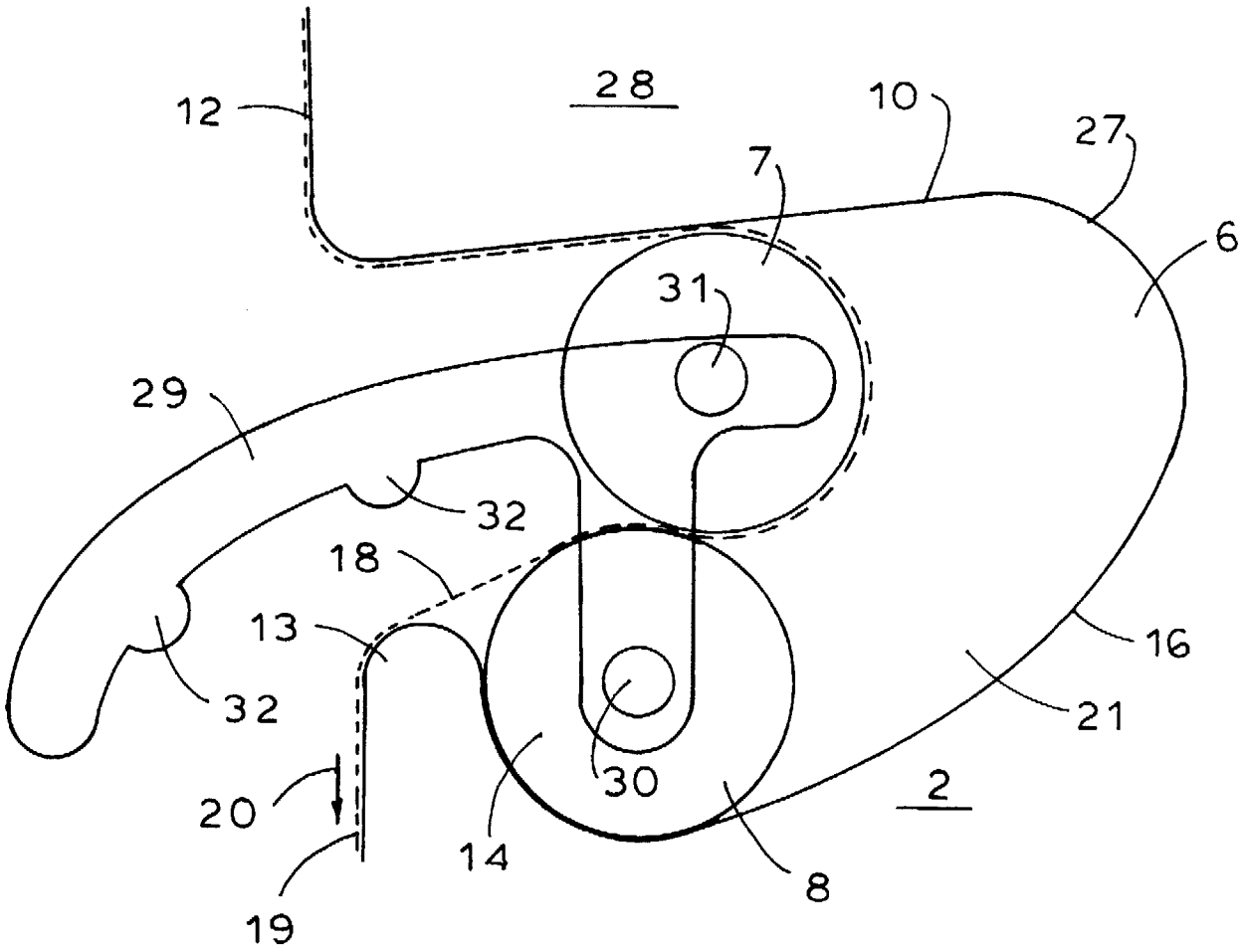
FIG. 12 is a diagram of the application of a section for stretching of a truck tarpauling.

It is considered advantageous that the device for holding of tensioned sheet-like material does not have to be used solely in combination with stretch frames, but can also be used for tensioning sheet-like materials which are for instance used as tarpaulins, e.g. truck tarpaulins. Especially in this case, but also for example in the case of a stretch frame used as screen printing frame according to FIG. 1, care has to be taken to prevent the bars 7, 8 from falling out of the groove 6. This is achieved by building the device according to FIG. 12, which shows a side view of a section segment. It is an end of section 2 provided with a coulisse 28 which covers at least partially an end of the groove 6 which itself is an open end. As a result the bars 7, 8 can not slide out in longitudinal direction from the groove 6 of section 2, when the latter is kept for instance in a vertical position. The coulisse 28 represents a holding device which limits the longitudinal mobility of the bars 7, 8. However in addition thereto care has to be taken to prevent the bars 7, 8 from falling out of the opening of groove 6, when the latter is arranged in a horizontal position according to FIG. 12, which can for instance be the case in a tensioning device for a truck tarpaulin, when the section 2 is fastened on the truck according to the illustration. For this or a similar case, the coulisse 28 is provided with a crank slot 29, wherein the bars 7, 8 are guided with crank pins 30, 31. The crank slot 29 extends inside the groove 6 and is basically horizontal or parallel to the longitudinal direction of the cross section of FIG. 6. Outside the groove 6 the crank slot 29 is slanted downward and can have recesses 32 for receiving the crank pins 30, 31 of the bars 7, 8, when these are not located inside the groove 6. The first bar 7 has then the deeper position, while the second bar 8 is arranged close to the groove. In order to stress the sheet-like material 18, respectively a tarpaulin, the material is pulled through with its end 19 between the surface 12 and the bar 8 close to the groove. After that the bar 8 by pressing in the material 18 into the groove 6 is pushed in a position closer to the groove or somewhat in a deeper position as shown in FIG. 12. Subsequently the free end 19 of the material 18 is pulled and in this way its stressing takes place.

The practical execution of the crank pins 30, 31 is achieved by offsetting the ends of bars 7, 8, whereby a Seeger circlip ring insures that the bars 7, 8 maintain a preset longitudinal position. The same effect is achieved when the ends of bars 7, 8 are provided with head screws which engage behind the coulisse 28 as seen from the bar side. If both groove ends are provided with coulisses, the engagement of coulisse 28 from the rear is no longer necessary. In FIG. 12 the coulisse is shown to be closed-ended. This is necessary only when there are no other ways to prevent the bars 7, 8 from unintentionally escaping through the crank slot 29.

We claim:

1. A device for tensioning a sheet material and retaining the sheet material in a tensioned state, said device comprising:

a stretching frame formed from a plurality of frame sections adapted to be spanned by a sheet material to be tensioned, said sheet material lying along a surface of said frame;

a longitudinal groove formed in each of said frame sections and opening at said surface at a narrow elongated mouth, said grooves each having a projection overhanging one side of the respective groove and defining a lip of the mouth, and opposite wall portions converging in a wedge shape toward said mouth, at least one of said wall portions being of circular arc segmental shape with a respective radius; and two rigid cylindrical bars of round cross section in each of said grooves and extending at least part of the length thereof, said sheet material having a loop extending around only one of said bars and passing between said one of said bars and one of said wall portions juxtaposed therewith and passing between said bars whereby the other of said bars bears directly against another of said wall portions juxtaposed therewith, a first of said bars having a radius corresponding substantially to the radius of said circular arc segmental shape and both said first of said bars and a second of said bars having diameters less than a width of said mouth, a sum of said diameters being greater than said width of said mouth, whereby upon tensioning of said sheet material said loop pulls said one of said bars toward said mouth and friction of said sheet material between said bars causes said other of said bars to roll towards said mouth and wedge said bars against one another and said sheet material.

2. The device defined in claim 1 wherein said first of said bars is the bar looped by said sheet material, said circular arc segmental shape being provided adjacent said projection.

3. The device defined in claim 1 wherein said one of said bars is said second of said bars and said circular arc segmental shape is adjacent said projection.

4. The device defined in claim 1 wherein said projection is provided at a side of said groove proximal to an opening in said frame to be spanned by the sheet material.

5. The device defined in claim 4 wherein said mouth is defined by a shoulder projecting toward said loop.

6. The device defined in claim 4 wherein a wall portion of said groove opposite said projection is planar.

7. The device defined in claim 1 wherein said wall portions are defined by arcs of circles having closely-spaced centers, a center of one of said bars substantially coinciding with at least one said center of said circular arcs in a position of said bars wherein said bars are wedged against one another and said sheet material.

8. The device defined in claim 1 wherein at least one of said bars projects from an end of said groove and is configured to receive a handle for rotating same.

9. The device defined in claim 1 wherein said sections of said frame are mitered at corners thereof and are all formed with respective said grooves and holes at end portions of said sections afford access to respective bars in said grooves.

10. The device defined in claim 1 wherein each section has one end abutting a longitudinal side of an adjoining section at an end portion thereof and another end open at the perimeter of said frame to afford access to one of said bars therein.

11. The device defined in claim 1 wherein said bars have diameters differing from one another.

12. The device defined in claim 1 wherein a wall against which said first bar bears upon tensioning of said sheet material is provided with a coating changing the friction coefficient in this region.

13. A device for tensioning a sheet material and retaining the sheet material in a tensioned state, said device comprising:

a stretching frame formed from a plurality of frame sections adapted to be spanned by a sheet material to be tensioned, said sheet material lying along a surface of said frame;

a longitudinal groove formed in each of said frame sections and opening at said surface at a narrow elongated mouth, said grooves each having a projection overhanging one side of the respective groove and defining a lip of the mouth, and opposite wall portions converging in a wedge shape toward said mouth, at least one of said wall portions being of circular arc segmental shape with a respective radius;

two rigid cylindrical bars of round cross section in each of said grooves and extending at least part of the length thereof, said sheet material having a loop extending around only one of said bars and passing between said one of said bars and one of said wall portions juxtaposed therewith and passing between said bars whereby the other of said bars bears directly against another of said wall portions juxtaposed therewith, a first of said bars having a radius corresponding substantially to the radius of said circular arc segmental shape and both said first of said bars and a second of said bars having diameters less than a width of said mouth, a sum of said diameters being greater than said width of said mouth, whereby upon tensioning of said sheet material said loop pulls said one of said bars toward said mouth and friction of said sheet material between said bars causes said other of said bars to roll towards said mouth and wedge said bars against one another and said sheet material; and a holding device limiting at least transverse mobility of said bars out of said groove, said holding device including a coulisse and coaxial crank pins guiding said bars in said coulisse.

14. A method of tensioning a sheet material and retaining the sheet material in a tensioned state, comprising the steps of:

(a) spanning a sheet material to be tensioned across a stretching frame formed from a plurality of frame sections adapted to be spanned by a sheet material to be tensioned so that said sheet material lies across an opening of the frame and along a surface of the frame at which longitudinal grooves formed in said frame sections open at narrow elongated mouths, said grooves each having a projection overhanging one side of the respective groove and defining a lip of the respective mouth and opposite a wall portion converging a wedge shape toward the respective mouth, at least one of the wall portions being of circular arc segmental shape with a respective radius, said sheet material extending across said mouths;

(b) dropping a first rigid cylindrical bar of round cross section in each of said grooves so that said sheet material is looped around only of said first bars in each of said grooves;

(c) dropping a second rigid cylindrical bar of round section in each of said grooves between the sheet material looped around the respective first bar and a wall portion of the respective groove; and (d) pulling said sheet material across said surfaces of said sections away from said opening to lodge one of said bars beneath said projection and tension said sheet material, thereby pulling said first bar toward the respective mouth and frictionally rolling said second bar in each groove toward said mouth to switch said bars against one another and said sheet material.

15. The method defined in claim 14, further comprising the step:

(e) of additionally rotating at least one of said bars from a location outside said groove to further secure said bars in the respective grooves against one another.

* * * * *